US007304253B2

(12) United States Patent
Lee

(10) Patent No.: US 7,304,253 B2
(45) Date of Patent: Dec. 4, 2007

(54) SWITCHING DEVICE OF AN IMAGE RECORDING AND REPLAYING APPARATUS

(75) Inventor: Sang-in Lee, Anyang-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/983,590

(22) Filed: Nov. 9, 2004

(65) Prior Publication Data

US 2006/0016671 A1 Jan. 26, 2006

(30) Foreign Application Priority Data

Jul. 22, 2004 (KR) ..... 10-2004-0057108

(51) Int. Cl.
*H01H 3/00* (2006.01)

(52) U.S. Cl. ..... 200/5 R; 200/18; 200/339

(58) Field of Classification Search ..... 200/5 A, 200/5 R, 6 R, 17 R, 18, 302.1–302.3, 315, 200/316, 1 B, 1 V, 339, 557
See application file for complete search history.

(56) References Cited

U.S. PATENT DOCUMENTS 4,611,102 A * 9/1986 Ishida ..... 200/5 R
4,692,570 A * 9/1987 Barlian et al. ..... 200/4
5,294,121 A * 3/1994 Chiang ..... 200/5 R
5,508,479 A * 4/1996 Schooley ..... 200/5 R
5,621,196 A * 4/1997 Nishijima et al. ..... 200/6 A

FOREIGN PATENT DOCUMENTS

| | | |
|---|---|---|
| JP | 54-146374 | 10/1979 |
| JP | 60-42239 | 3/1985 |
| JP | 1-103235 | 7/1989 |
| JP | 10-040780 | 2/1998 |

* cited by examiner

*Primary Examiner*—Elvin Enad
*Assistant Examiner*—M. Fishman
(74) *Attorney, Agent, or Firm*—Staas & Halsey LLP

(57) ABSTRACT

A switching device of an image recording and replaying apparatus, having: a frame with a button sheet having a guide boss opening positioned in a center of the button sheet and operation boss openings positioned around the guide boss opening, pairs of the operation boss openings being oppositely disposed with respect to the guide boss opening; a switchboard placed on a first side of the frame and having tact switches facing respective operation boss openings; an integrated button disposed to be elastically biased toward a second side of the frame opposite the first side, and having a guide boss inserted into the guide boss opening and operation bosses inserted into respective operation boss openings; and a fixation holder disposed on the guide boss to fix the integrated button to the frame, such that the operation bosses continuously contact with corresponding tact switches.

13 Claims, 4 Drawing Sheets

SWITCHING DEVICE OF AN IMAGE RECORDING AND REPLAYING APPARATUS

CROSS-REFERENCE TO RELATED APPLICATIONS

This application claims the benefit of Korean Patent Application No. 2004-57108 filed on Jul. 22, 2004, in the Korean Intellectual Property Office, the disclosure of which is incorporated herein by reference.

BACKGROUND OF THE INVENTION

1. Field of the Invention

The present invention relates to a switching device and more particularly, to a switching device to operate an image recording and replaying apparatus such as a video cassette recorder (VCR), a compact disc player (CDP), or a digital versatile disc (DVD) player.

2. Description of the Related Art

An integrated button structure is often adopted as a switching device of various types of image recording and replaying apparatuses such as VCRs, CDPs, DVD players, and the like. The integrated button refers to an individual operation of switches, for instance, four tact switches, by pressing left and right keys and top and bottom keys of one button. One typical example of such a switching device with the integrated button is shown in FIGS. 1 to 4.

As is shown in FIGS. 1 to 3, a switching device of a typical image recording and replaying apparatus includes a frame 10, a switchboard 20, an integrated button 30, and a front panel 40.

The frame 10 has a button sheet 11 recessed a predetermined depth from a first surface of the frame 10, and a guide boss opening 12 positioned in a center of the button sheet 11. Four operation boss openings 13 are positioned in top, bottom, left, and right sides, respectively, around the guide boss opening 12. Also, four tension ribs 14 are positioned in a diagonal direction of the button sheet 11.

Four tact switches 21 are mounted on the switchboard 20, and are disposed on an inner side of the frame 10, such that the four tact switches 21 correspondingly face the operation boss openings 13. Herein, the four tact switches 21 are switches to perform functions of play, pause, stop, fast forward, and fast rewind.

The integrated button 30 is disposed on the button sheet 11 of the frame 10, and includes a guide boss 32 inserted into the guide boss opening 12, and four operation bosses 33 individually inserted into the respective operation boss openings 13. Also, there are four function keys to operate the four tact switches 21 in top, bottom, right, and left sides of the integrated button 30.

The front panel 40 is coupled with the frame 10, and an exposure opening 41 exposing the integrated button 30 is positioned in a predetermined portion of the front panel 40. The integrated button 30 is disposed to be elastically biased towards an outer side by the several tension ribs 14 positioned on the button sheet 11 of the frame 10. Also, the integrated button 30 is maintained in a designated position by being supported in an inner edge side of the exposure opening 41 of the front panel 40.

By selectively pressing top and bottom and left and right ends of the integrated button 30, a desired function is selected on the switching device of the image recording and replaying apparatus configured as described above, by the operation bosses 33 operating the respective tact switches 21.

In the switching device of the image recording and replaying apparatus, to select a desired function, there should be a uniformly maintained gap G between each two of the operation bosses 33 and the tact switches 21. When one end of the integrated button 30, for instance, the top end, is pressed to correspondingly operate one of the tact switches 21 disposed in the top side of the switchboard 20, so that the tact switches 21 disposed in left and right sides of the switchboard 20 are not operated. As is shown in FIG. 4, a moving distance of a top operation boss 33-1 is twice of that of a left or right operation boss 33-2 when the top operation boss 33-1 is depressed, and thus, the gap G is necessarily set to be longer than a distance that is one half of the distance that the top operation boss 33-1 fully moves. If the gap G is maintained with a lesser distance, sensitivity of the integrated button 30 is reduced, or more than two functions may be selected. Because of the gap G with the properly maintained distance, when the top end of the integrated button 30 is pressed, only a desired tact switch 21 is pressed and operated without operating non-desired tact switches 21 adjacent to the top end of the integrated button 30. This selective operation of the tact switch 21 can be identically applied to the left and right ends and the bottom end of the integrated button 30.

But in the conventional image recording and replaying apparatus, since the gap G exists between the operation bosses 33 and the tact switches 21, an operating distance of each tact switch 21 is unnecessarily elongated. As a result, an operator feels the integrated button 30 moving loosely, or senses a poor operative feeling.

Also, if a typical button and the integrated button are placed on one panel, the typical button and the integrated button may be sensed to have different operative feelings based on the above described reason. Since the loose moving of the button and the poor operative feeling may impede quality enhancement of products, it is necessary to develop a new solution for these problems.

SUMMARY OF THE INVENTION

It is, therefore, an aspect of the present invention to provide a switching device of an image recording and replaying apparatus capable of contributing to a quality enhancement by preventing an integrated button of the switching device from loosely moving, and improving operative feeling of the integrated button to be as good as that of a typically structured button.

In accordance with one aspect of the present invention, there is provided a switching device of an image recording and replaying apparatus, comprising: a frame having a button sheet, on which a guide boss opening is positioned in a center of the button sheet, and a plurality of operation boss openings positioned around the guide boss opening, pairs of the operation boss openings being oppositely disposed with respect to the guide boss opening; a switchboard being placed on a first side of the frame and having a plurality of tact switches, each being mounted at a position corresponding to one of the operation boss openings; an integrated button having a guide boss inserted into the guide boss opening and a plurality of operation bosses inserted into respective operation boss openings and being disposed, such that the integrated button is elastically biased toward a second side of the frame opposite the first side; and a fixation holder disposed on the guide boss, which protrudes toward the first side of the frame to fix the integrated button to the frame, such that the operation bosses make continuous contact with corresponding tact switches.

In accordance with another aspect, the button sheet comprises a plurality of tension ribs, respectively positioned between adjacent operation boss openings, and biasing the integrated button toward the second side of the frame.

In accordance with still another aspect, the switching device further comprises a front panel, wherein the front panel has an exposure opening exposing the integrated button. A predetermined gap exists between the integrated button and an inner edge side of the exposure opening.

In accordance with yet another aspect, a stepped unit is positioned on the guide boss, and the fixation holder is fused to adhere to the guide boss, to cohere with the stepped unit. According to one aspect, the fixation holder is a ring-shaped molded material having a first surface contacted to the first side of the frame.

Additional aspects and/or advantages of the invention will be set forth in part in the description which follows, and in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings, of which.

DETAILED DESCRIPTION OF THE PREFERRED EMBODIMENTS

Figure 1:
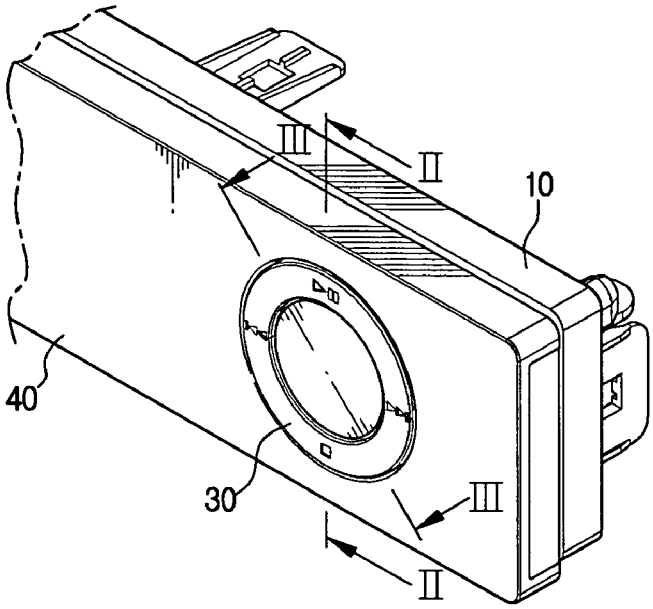
FIG. 1 (PRIOR ART)
FIG. 1 is a perspective view showing a conventional switching device employed in a digital versatile disc (DVD) player, which is one type of conventional image recording and replaying apparatus.
Figure 2:
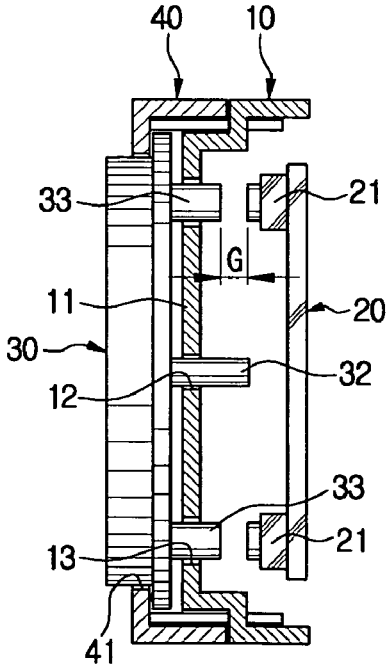
FIG. 2 (PRIOR ART)
FIG. 2 is a cross-sectional view of the conventional switching device of FIG. 1, taken along a line II-II.
Figure 3:
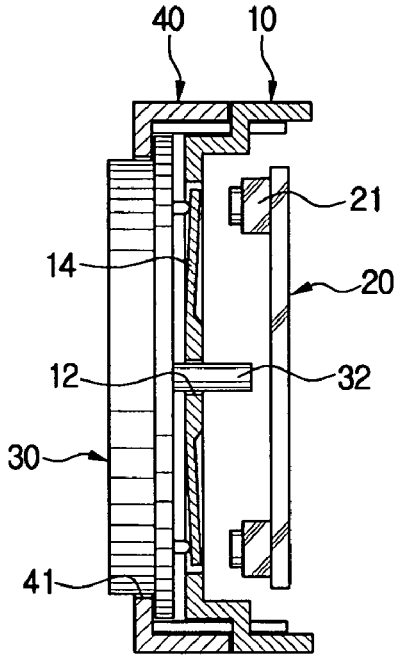
FIG. 3 (PRIOR ART)
FIG. 3 is a cross-sectional view of the conventional switching device of FIG. 1, taken along a line III-III.
Figure 4:
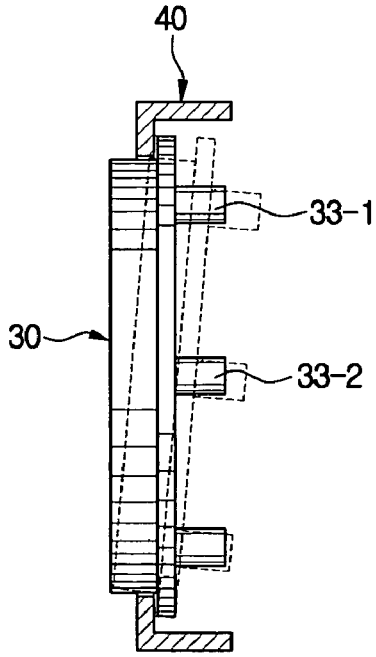
FIG. 4 (PRIOR ART)
FIG. 4 is a diagram depicting movement of an integrated button during operation of the conventional switching device of FIG. 1.
Figure 5:
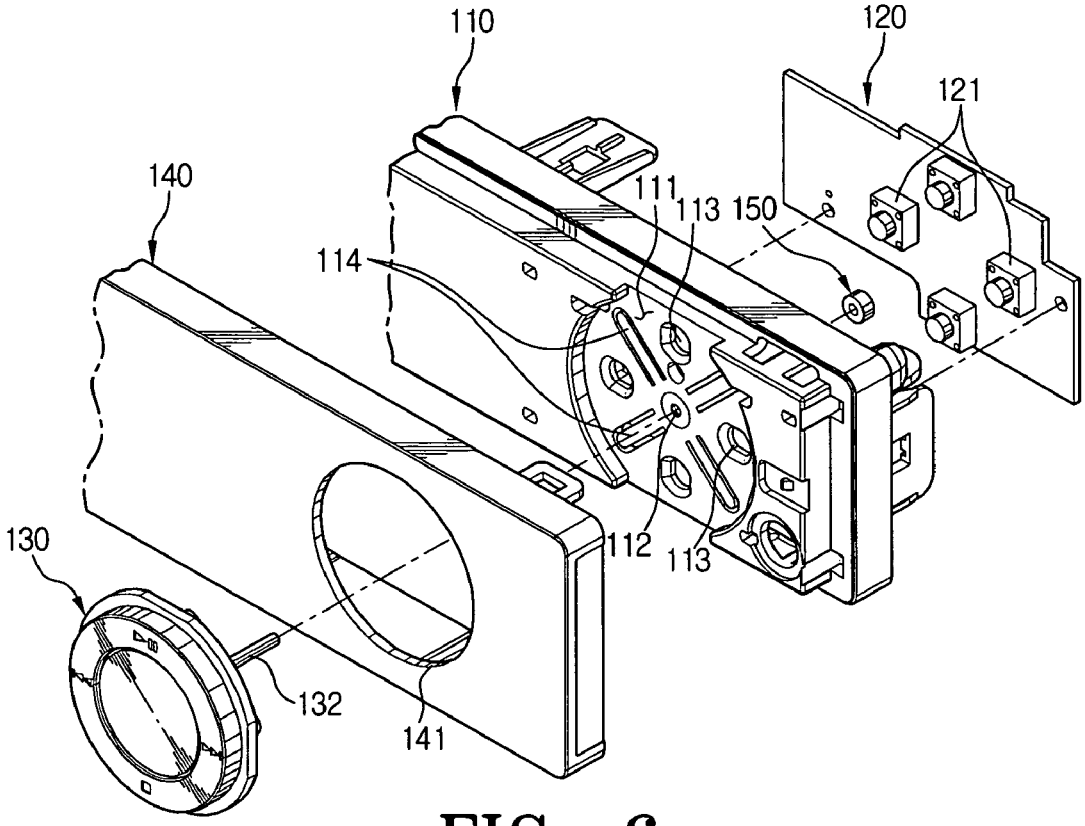
FIG. 5 is an exploded perspective view showing a switching device of an image recording and replaying apparatus in accordance with an embodiment of the present invention.

Reference will now be made in detail to embodiments of the present invention, examples of which are illustrated in the accompanying drawings, wherein like reference numerals refer to the like elements throughout. The embodiments are described to explain the present invention by referring to the figures.

FIGS. 5 to 8 show a switching device of an image recording and replaying apparatus in accordance with an embodiment of the present invention. As is shown in FIGS. 5 to 8, the image recording and replaying apparatus includes a frame 110, a switchboard 120, an integrated button 130, a front panel 140, and a fixation holder 150.

The frame 110 has a button sheet 111 recessed a predetermined depth from a first surface of the frame 110, and a guide boss opening 112 is positioned in a center of the button sheet 111. Four operation boss openings 113 are positioned in top, bottom, left, and right sides, respectively, around the guide boss opening 112. Also, four tension ribs 114 are positioned in a diagonal direction of the button sheet 111. That is, one of the tension ribs 114 is positioned between each adjacent pair of the operation boss openings 113.

Four tact switches 121 are mounted on the switchboard 120 and are disposed on an inner side of the frame 110 such that the four tact switches 121 correspondingly face the operation boss openings 113. According to one embodiment, the four tact switches 121 are switches to perform functions of play, pause, fast forward, and fast rewind.

The integrated button 130 is positioned on the button sheet 111 of the frame 110, and includes a guide boss 132 inserted into the guide boss opening 112 and four operation bosses 133 individually inserted into the respective operation boss openings 113. Also, there are four function keys to operate the four tact switches 114 in top, bottom, right, and left sides of the integrated button 130. The integrated button 130 is elastically biased in an outward direction by the several tension ribs 114 positioned on the button sheet 111 of the frame 110.

The front panel 140 is coupled with the frame 110, to cover a whole frontal side of the frame 110. And an exposure opening 141 exposing the integrated button 130 is positioned in a predetermined portion of the front panel 140.

The fixation holder 150 is disposed on the guide boss 132, which protrudes towards a rear side of the frame 110, to fixate the integrated button 130 to the frame 110, to maintain each of the operation bosses 133 of the integrated button 130 in a contact with each of the corresponding tact switches 121.

In more detail, the integrated button 130 is elastically biased in the outward direction by the plurality of the tension ribs 114 on the button sheet 111 of the frame 110. Also, the fixation holder 150 fixes the integrated button 130, so that the integrated button 130 is not separated outwardly.

Figure 8:
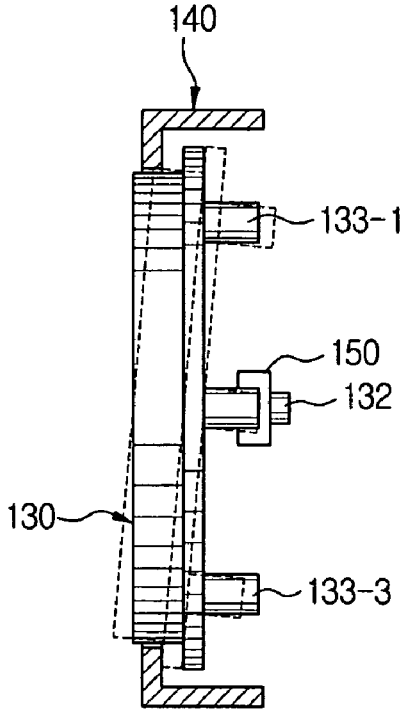
FIG. 8 is a diagram showing movement of an integrated button during operation of the switching device of FIG. 5.

The integrated button 130 operates the tact switches 121 as the integrated button 130 moves in top, bottom, right, and left directions from the guide boss 132 through the use of the fixation holder 150. This operation mechanism is illustrated in FIG. 8. Therefore, unlike the conventional switching device, it is not necessary to maintain a gap between each of the operation bosses 133 and the corresponding tact switches 121. As a result of this elimination of the gap, it is possible to decrease an operation distance of the operation boss 133, thereby obtaining a good operative feeling of the integrated button 130.

Figure 6:
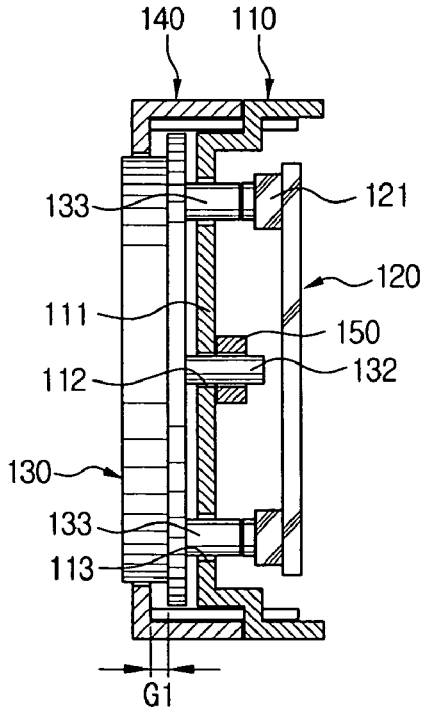
FIG. 6 is a cross-sectional view showing an assembled state of the switching device of FIG. 5.
Figure 7:
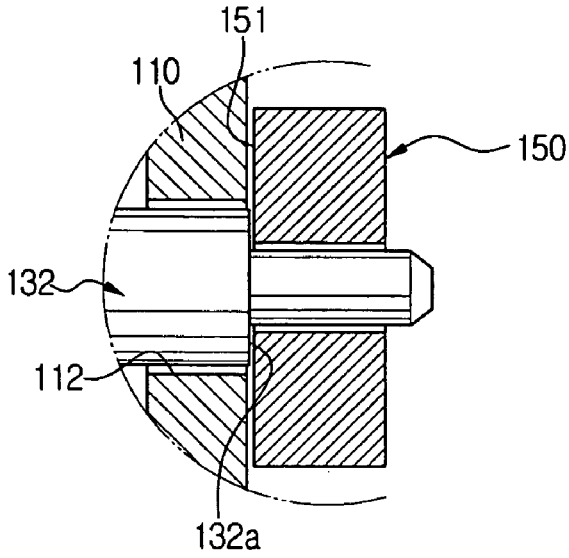
FIG. 7 is a detailed diagram showing a part of the switching device of FIG. 5.

Instead of having a gap between each of the operation bosses 133 and the corresponding tact switches 121, a predetermined gap G1 is positioned between an outer lip of the integrated button 130 and an inner edge portion of the exposure opening 141 of the front panel 140, for a smooth movement of the integrated button 130. This predetermined gap G1 is shown in FIG. 6.

A stepped unit 132*a* is positioned in the guide boss 132 of the integrated button 130, and the fixation holder 150 is fused to adhere to the guide boss 132, to thereby cohere with the stepped unit 132*a*. In other words, the fixation holder 150 is fused to the guide boss 132 adjacent to the stepped unit 132*a*.

Also, the fixation holder 150 has a ring-shaped molding material with a vertical surface 151 contacted with the rear side of the frame 110. In particular, the vertical surface 151 of the fixation holder 150 allows the integrated button 130 to maintain an intended planar level without being slanted.

In the switching device of FIGS. 5 to 8, if a portion of the integrated button 130, for instance, a top portion, is pressed to select a desired function, a top operation boss 133-1 and a bottom operation boss 133-3 move in opposite directions with respect to the guide boss 132. This opposite movements of the top operation boss 133-1 and the bottom operation boss 133-3 are shown in FIG. 8. Although not illustrated, the remaining operation bosses 133, i.e., left and right operation bosses, do not move.

Hence, even though a gap is not positioned between each of the operation bosses 133 and the corresponding tact switches 121, operation of more than one tact switch does not result from one time button manipulation. This effect makes it possible to eliminate a need for a gap positioned between each of the operation bosses 133 and the corresponding tact switches 121.

In addition, according to one embodiment, the fixation holder 150 is placed into a designated position simultaneously as a fusion and adherence operation is carried out during assembly, and as a result of this simultaneous performance, a manufacturing process is simplified.

The integrated button 130 operates the tact switches 121 as the integrated button 130 moves in top, bottom, left, and right directions with respect to the guide boss 132. Therefore, it is not necessary to have a gap positioned between each of the operation bosses 133 and the corresponding tact switches 121. This gap elimination decreases an operation distance of the operation boss 133, and thus, it is further possible to improve the operative feeing of the integrated button 130.

Moreover, the decrease in the operation distance of the operation boss 133 prevents an incidence of loose moving of the integrated button 130 usually caused by an unnecessarily elongated operation distance, thereby contributing to a quality enhancement of products.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A switching device of an electronic apparatus, comprising:

a switchboard having a plurality of tact switches;

a frame having a button sheet with operation boss openings positioned to correspond with the tact switches, and a guide boss opening;

an integrated button having a guide boss inserted through the guide boss opening, and operation bosses, each inserted through a corresponding operation boss opening and disposed adjacent to a corresponding tact switch, the button sheet biasing the integrated button in a first direction; and a fixation holder affixed to the guide boss, to secure the integrated button with respect to the frame, and position respective operation bosses adjacent to the respective corresponding tact switches;

wherein the guide boss comprises a stepped unit and the fixation holder is fused to the guide boss, and one of said operation bosses contacts the corresponding tact switch and activates the switching device, and an operation distance between the remaining operation bosses and corresponding tact switches decreased without operating the remaining operation bosses and the corresponding tact switches.

2. The switching device according to claim 1, wherein the button sheet comprises tension ribs biasing the integrated button in the first direction.

3. The switching device according to claim 2, wherein respective tension ribs are disposed between adjacent operation boss openings.

4. The switching device according to claim 1, wherein the fixation holder is disposed between the frame and the switchboard and prevents the integrated button from separating from the frame in the first direction.

5. The switching device according to claim 1, further comprising a panel encasing the integrated button and having an exposure opening exposing the integrated button.

6. The switching device according to claim 5, wherein a predetermined gap is positioned between an outer lip portion of the integrated button and an inner edge side of the panel.

7. The switching device according to claim 1, wherein:

the fixation holder is fused to the guide boss adjacent to the stepped unit.

8. The switching device according to claim 1, wherein:

the fixation holder is fused to adhere to the guide boss, to cohere with the stepped unit.

9. The switching device according to claim 1, wherein the fixation holder comprises a ring-shaped molded material.

10. The switching device according to claim 9, wherein the fixation holder has a first surface installed adjacent to the frame, to maintain the integrated button at an intended planar level.

11. The switching device according to claim 1, wherein the operation boss openings comprise four operation boss openings disposed at regular intervals around the guide boss opening.

12. The switching device according to claim 11, wherein:

when the integrated button is depressed to actuate a selected tact switch, an opposing operation boss, opposing a selected operation boss with respect to the guide boss, moves in the first direction, and only the selected tact switch is actuated.

13. A switching device of an electronic apparatus, comprising:

a frame having a button sheet, on which a guide boss opening is positioned in a center of the button sheet, and a plurality of operation boss openings positioned around the guide boss opening, pairs of the operation boss openings being oppositely disposed with respect to the guide boss opening;

a switchboard placed on a first side of the frame and having a plurality of tact switches, each being mounted at a position corresponding to one of the operation boss openings;

an integrated button having a guide boss inserted into the guide boss opening and a plurality of operation bosses inserted into respective operation boss openings, and being disposed such that the integrated button is elastically biased toward a second side of the frame opposite the first side; and a fixation holder disposed on the guide boss, which protrudes toward the first side of the frame, to fix the integrated button to the frame, such that the operation bosses make continuous contact with corresponding tact switches between the operation bosses and the corresponding tact switches;

wherein each of the operation bosses has an operation distance between the corresponding tact switches, and one of the operation bosses contacts the corresponding tact switch and activates the switching device, and the operation distance between the remaining operation bosses and the corresponding tact switches is decreased without operating the remaining operation bosses and the corresponding tact switches.

* * * * *

UNITED STATES PATENT AND TRADEMARK OFFICE

CERTIFICATE OF CORRECTION

PATENT NO. : 7,304,253 B2
APPLICATION NO. : 10/983590
DATED : December 4, 2007
INVENTOR(S) : Sang-in Lee It is certified that error appears in the above-identified patent and that said Letters Patent is hereby corrected as shown below:

Column 5, Line 61, after “switches” insert --is--.

Signed and Sealed this

Thirteenth Day of May, 2008

JON W. DUDAS
*Director of the United States Patent and Trademark Office*